350-357 SR
FFR07 XR 4,519,530

5-34

United States Patent [19]

Schmidt

[11] Patent Number: 4,519,530

[45] Date of Patent: May 28, 1985

[54] SELF-CLOSING DISPENSER

[76] Inventor: Gerhard S. E. Schmidt, 208 Duplex Ave., Toronto, Ontario, Canada

[21] Appl. No.: 469,945

[22] Filed: Feb. 25, 1983

[51] Int. Cl.[3] ..... B05B 11/04

[52] U.S. Cl. ..... 222/494; 222/496; 222/559; 222/511

[58] Field of Search ..... 222/212, 213, 494, 495, 222/496, 497, 545, 559, 491, 511, 518; 137/859, 860

[56] References Cited

U.S. PATENT DOCUMENTS 4,141,474 2/1979 Nilson ..... 222/494
4,186,882 2/1980 Szczepanski ..... 222/212
4,408,702 10/1983 Horvath ..... 222/496

*Primary Examiner*—Joseph J. Rolla
*Assistant Examiner*—Louise Heim
*Attorney, Agent, or Firm*—George A. Rolston

[57] ABSTRACT

A self-closing dispenser device having a generally rigid valve support with a two-way passageway for dispensing in one direction and return air flow in the other direction, a diaphragm on one side of the valve support, a valve member on the other side of the valve support, porting in the diaphragm, a valve stem connected to the diaphragm member and extending through the two-way passageway, and having a valve closure surface and a dispensing opening in the valve member, normally closed by the valve closure surface and movable outwardly for ejection of material, and the valve stem and closure surface being movable inwardly away to permit re-entry of air.

6 Claims, 3 Drawing Figures

SELF-CLOSING DISPENSER

The invention relates to a self-closing dispenser for liquid and flowable products.

BACKGROUND OF THE INVENTION

Flowable products such as liquid soaps, adhesives, flavourings, health care products, lubricants and a wide variety of other products are frequently packaged in containers from which they may be dispensed by pressure. Typically, the container is resilient, and may be squeezed thus creating a sufficient dispensing pressure. In other cases pressure may be supplied in other ways, and the container may be rigid. Preferably a dispenser nozzle for such a product will permit dispensing of the liquid when the pressure is applied and will immediatley shut off flow as soon as it is discontinued. Ideally, this function should be performed without having to manipulate the dispenser nozzle, and without having to remove or replace a cap.

In a typical case, such dispenser will in fact be incorporated in the cap of the container, and will preferably serve to seal and close the container after it has been initially filled in the factory, until it is sold to the user. In the simplest system the container is simply inverted and squeezed.

In most cases in the past the dispenser nozzle has been relatively inefficient, and after use it was necessary to stand the container on its base "the right way up", to prevent continued flow of liquid.

This allowed air to flow into the container through the dispenser, to replace the liquid lost during dispensing.

Unfortunately it had the undesirable result of drying out the dispenser. This rapidly became clogged with accumulations of dried liquid, and in many cases it became useless.

While it is no doubt possible to construct a relatively complex dispenser valve performing these various functions, it is obvious that in order to achieve any wide degree of acceptance, especially in connection with relatively low cost products, the dispenser must be of low cost, simple construction, such that it does not require complicated assembly or manufacturing steps, and incorporates a minimum number of parts.

In order to avoid the problem of drying out the dispenser it has been proposed to locate the dispenser at the bottom of the container so that it is essentially "upside down".

However, when this is done the dispenser is thus required to operate under the full hydrostatic pressure of the material in the container, and still act as a seal. This particular feature has proved to be unusually difficult to achieve. In connection for example with liquid soaps and cleansers, it is desirable to market such products in special resilient containers which are provided with a suspension attachment by means of which they may be hung in position, such as adjacent to a work place, sink, or in a shower, for example. The product may then be readily used simply by grasping the container upside down and then squeezing the container to eject a small quantity after which the container may be replaced or stored upside down.

The container holding the liquid will remain standing or hanging upside down with the dispenser at the bottom or at a lower region of the container, supporting the entire weight of liquid within the container.

In the past, dispenser caps have been proposed for this particular usage. However, they have been unsatisfactory to the extent that they did not provide a clean shut-off or sealing of the container, after squeezing had been discontinued. A small quantity of the liquid remains suspended as a droplet from the dispenser, or remains in the dispenser outlet. This liquid would then dry out and lead to malfunction of the dispenser. In some cases the dispenser was blocked, and in others it could cause unsightly deposits or drips of the liquid around the location.

A blocked dispenser would require an extra cleaning operation, and products packaged in this way have not found wide acceptance.

Another problem which is not readily apparent is caused by the bottles or containers themselves. These containers are formed of plastic material, typically being manufactured by blow moulding techniques and for reasons of economy, are manufactured to certain strict limitations as to cost. As a result, the bottles or containers exhibit a comparatively significant degree of irregularity, especially in the region of the neck, or other portion to which the dispenser is attached. In the majority of cases, the dispenser is attached to the neck by some form of threaded means, typically a threaded collar, and is thus clamped into engagement with the edge of the neck. The area of the neck to which the cap is attached is not manufactured to any critical degree of tolerance, and the irregularities present at this point cause significant problems in both the sealing of the dispenser and also in its operation.

The dispenser will usually be manufactured of thermoplastic material, by injection moulding or the like, and may appear to function in a satisfactory manner in the laboratory. However, when it is clamped to a relatively irregular shaped bottle top, such a dispenser may be distorted so that it no longer functions in the manner for which it is intended, or may simply make an inadequate seal with the edge of the neck. In either case, leakage will result.

Some dispensers have been proposed which are essentially two, valved passageways, one valve allowing ejection of liquid and the other allowing re-entry of air.

These proposals do not deal satisfactorily with the problem of the liquid residue left in the ejection valve.

The invention therefore has as its broad objective the provision of a self-closing dispenser for use in dispensing flowable materials, e.g., liquids, from a container by means of pressure, such dispenser being capable of dispensing such material from such container when pressure is applied, and instantaneously shutting off flow when pressure is discontinued and allowing air to return through the ejection passage, to remove the residual material.

BRIEF SUMMARY OF THE INVENTION

In order to achieve these objectives, the invention provides a self-closing dispenser device comprising a valve support formed of generally rigid material, and defining a single, two-way passageway for flow of material therethrough and return air flow passage means, a flexible valve member on one side of said valve support, a diaphragm member on the other side of said valve support, porting means in said diaphragm member, whereby said material may flow into the space between said valve support and said diaphragm member, a valve stem connected to said diaphragm member and extending through said two-way passageway, and a dispensing opening in said valve member, said opening being normally closed by contact with such valve stem and said valve member being movable outwardly away from said valve stem for ejection of material, and said valve stem being moveable inwardly away from said valve member to permit re-entry of air.

More particularly, the invention seeks to provide such a self-closing dispenser which will operate effectively when subjected to the hydrostatic pressure of the material within the container.

More particularly, the invention seeks to provide such a self-closing dispenser which may be attached to containers having necks exhibiting relatively substantial irregularities without impairing its function.

A significant advantage of this form of operation is the fact that the small quantity of liquid which is actually contained in the passageway is sucked back into the interior of the container by the air return. This effectively prevents the problem of dripping of liquid after the container has been released.

Drying out of the dispenser is not a problem since the passageway is self-closing as soon as the air return is completed.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
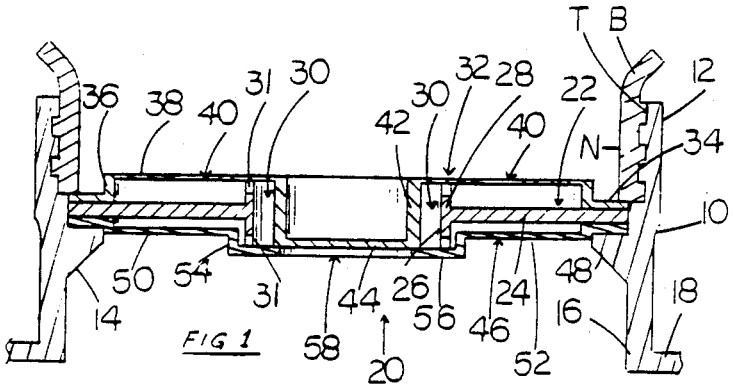
FIG. 1 is a sectional side elevation of the self-closing dispenser according to the invention, shown in its closed position, and shown in association with the neck of a container, and a cap.
Figure 2:
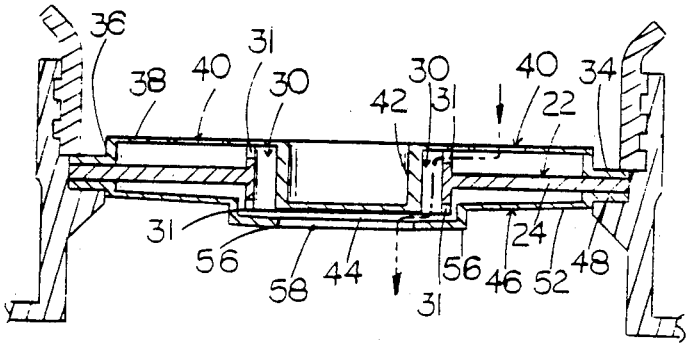
FIG. 2 is a sectional side elevation corresponding to FIG. 1, but showing the dispenser in the dispensing mode, i.e., when the container is being squeezed and liquid is actually being ejected, and, FIG. 3 is a sectional side elevation corresponding to FIG. 1, in the air return mode, i.e., when the container has been released, and air is returning into the container through the dispenser.

It will have already been noted from FIGS. 1 and 2 that the illustrations show the dispenser being used as it were, "upside down," that is to say, at the bottom end of a container. It is assumed that the container is full of a relatively viscous liquid, such as a liquid hand cleanser, dishwashing fluid, or the like. A wide variety of other liquids or flowable products may be stored in such a container and dispensed, as indicated above.

As shown in FIG. 1, a typical resilient squeeze bottle is shown fragmentarily as B, and has a neck N. In this particular example, the neck N is provided with threads T.

It will of course be appreciated that the design and shaping of the bottle B in the neck N may vary widely from one maker to another, and some bottles may be provided with necks having some other form of fastening means other than the threads T, which are merely shown by way of example.

A bottle cap indicated generally as 10 has an internally threaded sleeve portion 12 inter-engaging with the threads T on the neck N of the bottle.

An inwardly directed retaining shoulder 14 is formed on the cap 10, and optional stand portion 16 extends downwardly therefrom, which may have an outwardly directed flange 18 if desired. This facilitates standing the bottle B upside down in the position shown in FIG. 1, beside a work place, or in a washroom.

It will of course be appreciated that other manufacturers may prefer a bottle B having an integral hanging device such as is well known in the art by means of which the bottle may simply be hung upside down.

In accordance with the invention, the self-closing dispenser is shown generally as 20. It is of three part construction. A centre valve support portion 22 is of generally disc-like shape, in this embodiment, having a relatively rigid web portion 24, and an integrally formed central outer valve stop portion 26 extending outwardly. A further inward valve stop portion 28 extends inwardly, generally co-axially with outward stop portion 26. A central two-way passageway 30 is formed through web 24, through which contents of the bottle may be ejected during dispensing, and through which air may return when the bottle B is released.

The stop portions 26 and 28 may be provided with a plurality of notch-like openings 31 around their upper edges, and may be formed in various ways and shapes, as posts, ridges, buttons and the like.

An inner diaphragm indicated generally as 32 has an outer lip portion 34, and an outer wall portion 36 extending from the inner edge of the lip 34. In the embodiment shown, the wall 36 is of essentially the same height dimension as that of the inward neck 28.

A generally resilient flexible web 38 extends inwardly from the upper extremity of the wall 36. Web 38 is provided with a plurality of through openings 40 for two-way passage, in the one case of the liquid contents of bottle B and in the other case of return air.

The diaphragm member 32 is provided with a central axial valve stem portion 42, having a generally cylindrical shape in this embodiment, and having a width dimension less than that of the interior spacing of the inward and outward stops 28 and 26 and opening 30, whereby the valve stem portion 42 may fit along the central axis thereof, and define a substantial spacing there between, thereby permitting flow of liquid, and air, in the two directions aforesaid.

The stem portion 42 may be solid or hollow, or may be shaped as a rod and button, or trumpet shaped, in various ways.

However, the form of construction is not critical, and other forms of construction may be used if desired.

At the end of valve stem portion 42, a valve closure surface 44 is formed, the purpose of which will be described below.

Web 38 is resilient and flexible, so as to permit axial movement of valve stem 42 and valve closure surface 44 relative to outward and inward stops 26 and 28.

An outward valve member indicated generally as 46 is located outwardly of the centre member 22. Valve member 46 comprises an outward lip 48, a wall portion 50, and an inwardly extending resilient flexible web 52.

A further wall portion 54 extends from the inward extremity of the web 52.

A valve seating disc member 56 is formed on wall 54, and extends laterally across the end of the outward stop 26. A central dispensing opening 58 is provided having a predetermined diameter which is just less than the diameter of the valve closure surface 44 of valve stem 42.

Figure 3:
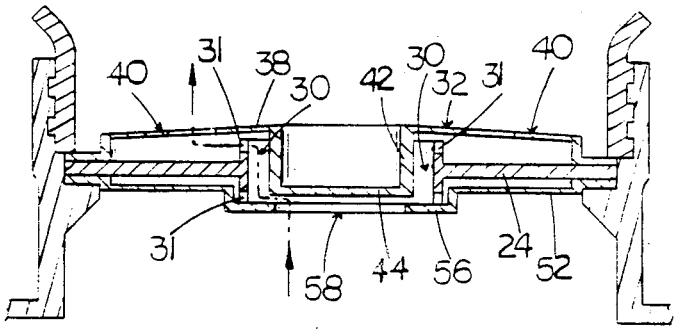

The mode of operation during dispensing and then during return air induction, is best shown with references to FIGS. 2 and 3.

FIG. 1 shows the invention in its closed and sealed state.

When the bottle B is inverted, the dispenser 20 will, of course, be continuously subject to the hydrostatic pressure of whatever material is stored within bottle B. The dispenser 20 is so designed as to resist such hydrostatic pressure, to prevent leakage.

During dispensing, the bottle B is squeezed, thereby increasing the pressure within the bottle B. This increase in pressure is applied through the contents typically being liquid material, through the openings 40 in the diaphragm member 32, down through the annular passageway 30 around inward and outward stops 28 and 26 and the valve stem 42 respectively, and is then applied to the valve seating disc 56. The increase in pressure is such that it will cause outward flexing of the web 52, thereby permitting the valve seating disc 56 to lift off the valve closure surface 44 of the stem 42. Liquid material can thus escape through opening 58.

Where the liquid is thick and viscous, some of the dispensing pressure will be applied to the diaphragm 32. This would have the effect of pressing the valve stem 42 and closure surface 44 outwardly. However, such outward movement is prevented by the inward stop portion 28.

As soon as the bottle B is released, the bottle walls (not shown) being resilient, will recover their normal shape, and this will create a negative pressure within the bottle B. Atmospheric air pressure will thus be applied through the opening 58.

When the dispensing pressure within the bottle is thus released, the web 52 of the outer valve member 46 will flex inwardly, bringing valve seating disc 56 back into contact with valve closure surfaces 44 of valve stem 42, and momentarily close off opening 58.

It will also be observed that such inward movement of web 52 will also bring the valve seating disc into contact with the outer extremity of the outward stop 26, which effectively limits further inward movement of valve seating disc 56.

Simultaneously, as the bottle B is released, the negative pressure then created within bottle B will permit the atmospheric air pressure exteriorally of the bottle B to be applied to the valve closure surface 44. Web 32 being resilient will thus be subjected to such pressure differential, and will flex inwardly (see FIG. 3). This inward flexing will cause valve closure surface 44 to lift inwardly off the valve seating disc 56, thereby permitting air to be inducted through opening 58, and up through the annular passage described above. Such air will then pass up into the bottle through openings 40.

As soon as the pressure within the bottle is equalized to atmospheric pressure, the web 32 will flex downwardly once more, causing the valve closure surface 44 to seat once more on the valve seating disc 56, thereby sealing off the bottle B.

It will thus be seen that the dispenser according to the invention provides for dispensing of the liquid, and inward flow of return air, through the same pathway. In this way, substantially instantaneous shutoff of flow of liquid is achieved as soon as the squeezing of the bottle B is discontinued. As soon as inward flow of return air has been completed, to equalize pressure, liquid will again flow through the passages 40, and through the passageway 30 down around the annular space, thereby completely refilling the passages within the dispenser.

Since the sealing point of the dispenser is between the valve closure surface 44 and the valve seating disc 56, which is at the last possible point before actual dispensing of the liquid, there will be no liquid remaining to be dried out during storage which in the past has caused problems such as clogging and jamming of the dispenser.

It will be understood that diaphragm 32, and valve disc 56 will be designed with a degree of resiliency, or inherent bias, sufficient to perform in the manner described. Such resiliency or bias will vary from on liquid material to another, and from one container size, or type, to another. In addition, care must be taken to ensure that the dispenser will be operable by the intended end-user. Thus products for home use, where they may be used by housewives or children, may require different specifications from those intended for commercial or industrial use. Those skilled in the art will readily understand these requirements and vary the specifications accordingly.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A self-closing dispenser device comprising;

a valve support formed of generally rigid material, and defining two-way passageway means for flow of material therethrough in one direction and return air flow in the other direction;

a resilient diaphragm member on one side of said valve support;

a resilient valve member on the other side of said valve support;

porting means in said diaphragm member, whereby said material may flow between said diaphragm member and said valve support;

a valve stem connected to said diaphragm member and extending through said two-way passageway means and having a valve closure surface;

a dispensing opening in said valve member, said opening being normally closed by contact with said valve closure surface and said valve member being movable outwardly away from said valve closure surface for ejection of material, and said valve stem and closure surface being movable inwardly away from said valve member to permit re-entry of air, and, stop means on said valve support for limiting movement of said valve stem, and of said valve member as aforesaid.

2. A self-closing dispenser device as claimed in claim 1, wherein said stop means are formed integrally with said valve support, and are located on opposite sides of said two-way passage means, and extend inwardly into engagement with said diaphragm member, and outwardly into engagement with said valve member, said stop means being discontinuous, and defining flow spaces therebetween, for flow of material therethrough into said two-way passage means, and for permitting flow of air therebetween, and into said two-way passage means as aforesaid.

3. A self-closing dispenser as claimed in claim 2, wherein said two-way passage means defines a predetermined cross-sectional flow area, and wherein said valve stem extending through said two-way passage means is of reduced cross-sectional area in relation thereto, thereby defining flow passage spaces between said valve stem and said two-way passage means.

4. A self-closing dispenser device as claimed in claim 3, wherein said dispensing opening and said valve member registers with said two-way passage means, and has a cross-sectional area less than the cross-sectional area of said two-way passage means.

5. A self-closing dispenser device as claimed in claim 4, wherein said diaphragm member and said valve member are generally disk-like shaped, and are formed with resilient portions, and wherein said valve stem is formed integrally with said diaphragm member, whereby when said diaphragm member moves away from said valve support, said valve stem moves in unison therewith to uncover said dispensing opening in said valve member.

6. A self-closing dispenser device as claimed in claim 5, wherein said valve support is of generally disk-like shape, and is sandwiched between said diaphragm member and said valve member, and is formed with generally annular central wall means surrounding said two-way passageway means, and including notch means formed in said walls, defining said stop means, and forming discontinuities therebetween for permitting flow therebetween into an outer said two-way passageway means.

* * * * *

4519530
BOULWARE U 91 066
ACCESSION: 4PFR07
MAIN COMMERCE
PLEASE STAPLE AT BOTTOM
03210095
03/21 ZIP:
HL
X019